US007769191B2

(12) United States Patent
Lee et al.

(10) Patent No.: US 7,769,191 B2
(45) Date of Patent: Aug. 3, 2010

(54) FLAT PANEL AUDIO OUTPUT APPARATUS AND VIDEO/AUDIO OUTPUT APPARATUS

(75) Inventors: Kyung-ju Lee, Gyeonggi-do (KR); Jeong-Seon Kim, Gyeonggi-do (KR); Valeri Toherniak, Gyeonggi-do (KR); Yang-sung Kim, Gyeonggi-do (KR); Young-hun An, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1296 days.

(21) Appl. No.: 11/260,291

(22) Filed: Oct. 28, 2005
(Under 37 CFR 1.47)

(65) Prior Publication Data

US 2007/0036388 A1 Feb. 15, 2007

(30) Foreign Application Priority Data

Oct. 28, 2004 (KR) ..... 10-2004-0086827

(51) Int. Cl.
*H04R 25/00* (2006.01)

(52) U.S. Cl. ..... 381/152; 381/333; 381/388; 381/431

(58) Field of Classification Search ..... 381/306, 381/152, 162, 99, 332–333, 388, 423, 432, 381/150, 431
See application file for complete search history.

(56) References Cited

U.S. PATENT DOCUMENTS 6,522,760 B2 * 2/2003 Azima et al. ..... 381/152
2002/0021812 A1 2/2002 Bank

FOREIGN PATENT DOCUMENTS

| | | |
|---|---|---|
| JP | 2000-092578 | 3/2000 |
| JP | 2000-236595 | 8/2000 |
| KR | 2002-95310 | 12/2002 |
| KR | 2004-0084760 | 10/2004 |

OTHER PUBLICATIONS

Korean Office Action for corresponding Korean patent Application No. 10-2004-0086827 dated Apr. 21, 2006.
International Publication WO01/87002 dated Nov. 15, 2001. (English Abstract and International Search Report Included Only).

* cited by examiner

*Primary Examiner*—Suhan Ni
(74) *Attorney, Agent, or Firm*—Staas & Halsey LLP

(57) ABSTRACT

A flat panel audio output apparatus including a plurality of flat panels; and one or more vibrators respectively provided to each of the flat panels to vibrate the flat panels to make a sound; wherein the one or more vibrators of each one of the respective flat panels receives audio signals of a different channel and/or a different frequency band than those received by the one or more vibrators of at least one of the remaining flat panels.

9 Claims, 9 Drawing Sheets

FLAT PANEL AUDIO OUTPUT APPARATUS AND VIDEO/AUDIO OUTPUT APPARATUS

CROSS-REFERENCE TO RELATED APPLICATIONS

This application claims the benefit of Korean Patent Application No. 2004-0086827, filed on Oct. 28, 2004, in the Korean Intellectual Property Office, the disclosure of which is incorporated herein by reference.

BACKGROUND OF THE INVENTION

1. Field of the Invention

The present invention relates to a flat panel audio output apparatus and a video/audio output apparatus, and, more particularly, to a flat panel audio output apparatus and a video/audio output apparatus which can output a sound according to a plurality of audio channels or a plurality of frequency bands.

2. Description of the Related Art

Conventionally, a cone-type speaker has been widely used in outputting a sound. The cone-type speaker generally comprises a cone made of paper, plastic, aluminum, or the like; a flexible surround surrounding the rim of the cone; and a corrugated spider circumferentially surrounding the vertex of the cone.

Recently, there has been developed a flat panel audio output apparatus outputting a sound through a flat panel. Here, the flat panel audio output apparatus makes a sound through a flat panel vibrated (or excited) by an exciter transforming an electric signal into a mechanical vibration.

Thus, the flat panel audio output apparatus comprises the flat panel making a sound, and the exciter placed on the flat panel and vibrating the flat panel.

Generally, in the flat panel audio output apparatus, two exciters, corresponding to two audio channels for a stereophonic sound, are placed on a single flat panel. Therefore, each exciter vibrates the flat panel on the basis of an electrical audio signal outputted from each respective audio channel, and the flat panel is vibrated by both exciters corresponding to the two audio channels, thereby making a sound.

However, in the conventional flat panel audio output apparatus, because the respective exciters corresponding to the audio channels are provided in the single flat panel in order to vibrate the single flat panel, interference arises between vibrations caused by the respective exciters corresponding to the two audio channels.

FIG. 1 illustrates interference between vibrations due to two audio channels in a conventional flat panel audio output apparatus 100. On a flat panel 110 of FIG. 1, 'Δ' indicates a sound position due to the vibration caused by a left exciter 120*a*, and 'x' indicates a sound position due to the vibration caused by a right exciter 120*b*.

Here, the sound positions of the flat panel 110 vibrated by the respective exciters 120*a* and 120*b* are distributed on the flat panel 110. Therefore, the flat panel 110 has an interference area A where interference arises between the vibrations caused by the respective exciters 120*a* and 120*b*.

The interference between the audio channels deteriorates the quality of a sound outputted from the flat panel audio output apparatus 100. Accordingly, there is a need to eliminate the interference between the audio channels of the flat panel audio output apparatus 100.

Further, if an audio output apparatus such as a loudspeaker can output sounds corresponding to a low-pitched sound, a middle-pitched sound and a high-pitched sound, i.e., corresponding to frequency bands without interference with regard to the same channel, sound quality will be more enhanced.

SUMMARY OF THE INVENTION

Accordingly, it is an aspect of the present invention to provide a flat panel audio output apparatus, and a video/audio output apparatus, which can output sounds according to frequency bands without interference between the sounds corresponding to the frequency bands.

Further, the present invention provides a flat panel audio output apparatus, and a video/audio output apparatus, which can prevent sound quality from being deteriorated due to interference between sounds outputted from a plurality of audio channels.

Additional aspects and/or advantages of the invention will be set forth in part in the description which follows and, in part, will be apparent from the description, or may be learned by practice of the invention.

The foregoing and/or other aspects of the present invention may be achieved by providing a video/audio output apparatus comprising a flat panel display module to display a picture; a plurality of flat panels spaced apart from one another, each of the flat panels facing at least one of the remaining flat panels, provided in front of a surface of the flat panel display module; one or more vibrators respectively provided to each of the flat panels to vibrate each of the flat panels to make a sound; and an audio signal generator to transmit audio signals corresponding to different frequency bands to the respective vibrators.

Each of the respective flat panels may have different coefficients of elasticity from each other; and the audio signal generator outputs the audio signals having the different frequency bands to each of the respective vibrators according to the coefficients of elasticity of the flat panels.

At least one of the flat panels may comprise a plurality of sound areas, and a division area to divide the at least one flat panel into the sound areas to prevent vibrations of the sound areas from interfering with each other; at least one of the vibrators is provided on each of the sound areas; and the audio signal generator respectively outputs the audio signals corresponding to different channels of a same frequency band to the at least one vibrator provided on each of the sound areas of the at least one flat panel.

The division area may have a coefficient of elasticity different from the coefficients of elasticity of the sound areas.

The division area may comprise a hardener, which causes the coefficient of elasticity different from the coefficient of elasticity of the sound areas.

The video/audio output apparatus may further comprise a transparent conductive body provided in the division area; and a power supply to supply power to the transparent conductive body, which causes the coefficient of elasticity different from the coefficient of elasticity of the sound areas.

The video/audio output apparatus may further comprise a supersonic generator to emit supersonic waves to the division area to prevent the vibrations of the sound areas from interfering with each other.

The video/audio output apparatus may further comprise at least one supporting member to support the plurality of flat panels so that each of the flat panels is spaced apart from one another.

The video/audio output apparatus may further comprise an anti vibration member disposed between each of the flat panels, to prevent vibration of a first one of the flat panels from being transmitted to a second one of the flat panels.

The foregoing and/or other aspects of the present invention may also be achieved by providing a video/audio output apparatus comprising a flat panel display module to display a picture; a plurality of flat panels spaced apart from one another, each of the flat panels facing at least one of the remaining flat panels, provided in front of a surface of the flat panel display module; one or more vibrators respectively provided to each of the flat panels to vibrate each of the flat panels to make a sound; and an audio signal generator to transmit audio signals corresponding to different channels to the respective vibrators.

At least one of the flat panels may comprise a plurality of sound areas, and a division area to divide the at least one flat panel into the sound areas to prevent vibrations of the sound areas from interfering with each other; at least one of the vibrators is provided on each of the sound areas; and the audio signal generator respectively outputs the audio signals corresponding to different frequency bands of a same channel to the at least one vibrator provided on each of the sound areas of the at least one flat panel.

The division area may have a coefficient of elasticity different from the coefficients of elasticity of the sound areas.

The division area may comprise a hardener, which causes the coefficient of elasticity different from the coefficient of elasticity of the sound areas.

The video/audio output apparatus may further comprise a transparent conductive body provided in the division area; and a power supply to supply power to the transparent conductive body, which causes the coefficient of elasticity different from the coefficient of elasticity of the sound areas.

The video/audio output apparatus may further comprise a supersonic generator to emit supersonic waves to the division area to prevent the vibrations of the sound areas from interfering with each other.

The foregoing and/or other aspects of the present invention may also be achieved by providing a flat panel audio output apparatus comprising a plurality of flat panels spaced apart from one another, each of the flat panels facing at least one of the remaining flat panels; one or more vibrators respectively provided to each of the flat panels to vibrate each of the flat panels to make a sound; and an audio signal generator to transmit audio signals corresponding to different frequency bands to the respective vibrators.

Each of the respective flat panels may have different coefficients of elasticity from each other; and the audio signal generator outputs the audio signals having the different frequency bands to each of the respective vibrators according to the coefficients of elasticity of the flat panels.

The foregoing and/or other aspects of the present invention may also be achieved by providing a flat panel audio output apparatus comprising a plurality of flat panels spaced apart from one another, each of the flat panels facing at least one of the remaining flat panels; one or more vibrators respectively provided to each of the flat panels to vibrate each of the flat panels to make a sound; and an audio signal generator to transmit audio signals corresponding to different channels to the respective vibrators.

The foregoing and/or other aspects of the present invention may also be achieved by providing a flat panel audio output apparatus comprising: a plurality of flat panels; and one or more vibrators respectively provided to each of the flat panels to vibrate the flat panels to make a sound; wherein the one or more vibrators of each one of the respective flat panels receives audio signals of a different frequency band than those received by the one or more vibrators of the remaining flat panels.

The foregoing and/or other aspects of the present invention may also be achieved by providing a flat panel audio output apparatus comprising: a plurality of flat panels; and one or more vibrators respectively provided to each of the flat panels to vibrate the flat panels to make a sound; wherein the one or more vibrators of each one of the respective flat panels receives audio signals of a different channel than those received by the one or more vibrators of at least one of the remaining flat panels.

The foregoing and/or other aspects of the present invention may also be achieved by providing a flat panel audio output apparatus comprising: a plurality of flat panels; and one or more vibrators respectively provided to each of the flat panels to vibrate the flat panels to make a sound; wherein the sound made by each of the respective flat panels is independently made corresponding to a single channel of an audio signal.

The foregoing and/or other aspects of the present invention may also be achieved by providing a flat panel audio output apparatus comprising: a plurality of flat panels; and one or more vibrators respectively provided to each of the flat panels to vibrate the flat panels to make a sound; wherein the sound made by each of the respective flat panels is independently made according to a frequency band of an audio signal.

BRIEF DESCRIPTION OF THE DRAWINGS

These and/or other aspects and advantages of the invention will become apparent and more readily appreciated from the following description of the embodiments, taken in conjunction with the accompany drawings of which.

DETAILED DESCRIPTION OF THE PREFERRED EMBODIMENTS

Figure 1:
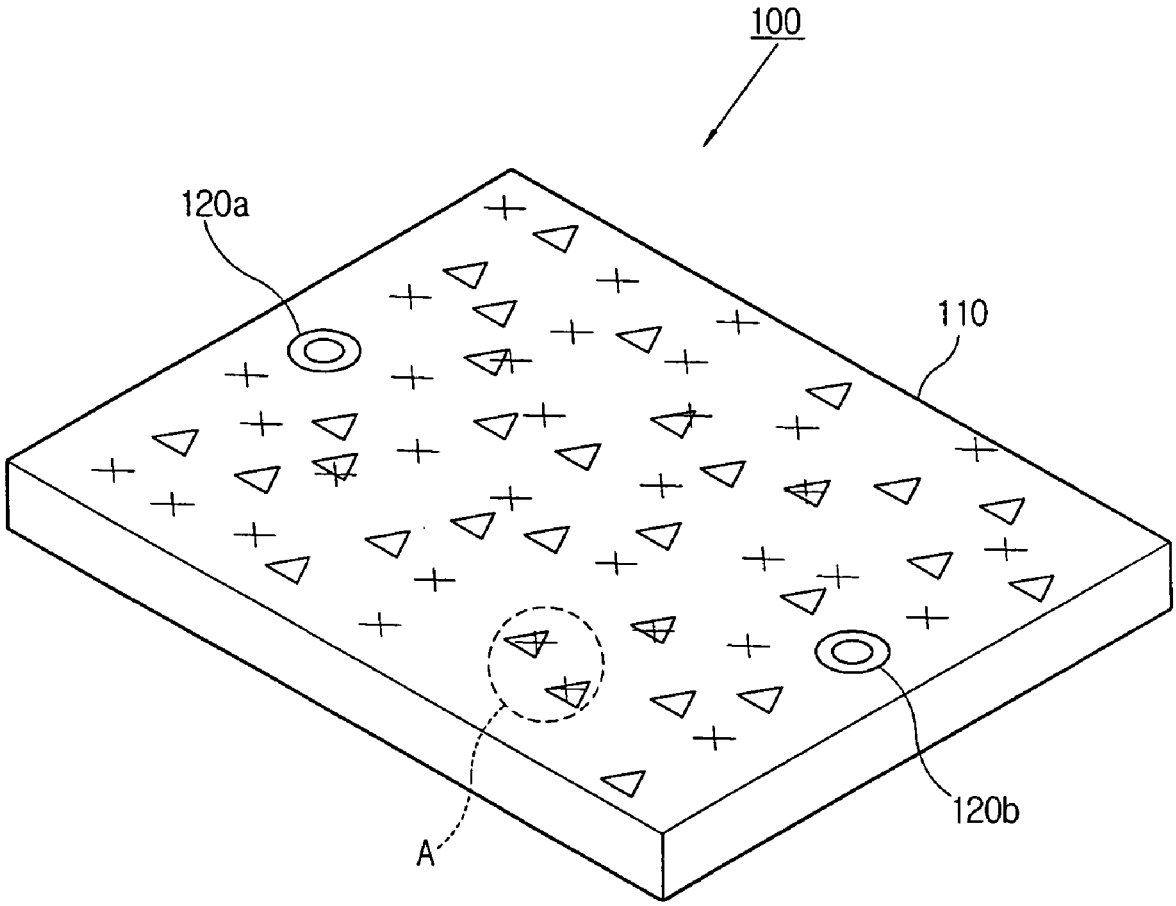
FIG. 1 (PRIOR ART)
FIG. 1 illustrates a conventional flat panel audio output apparatus.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
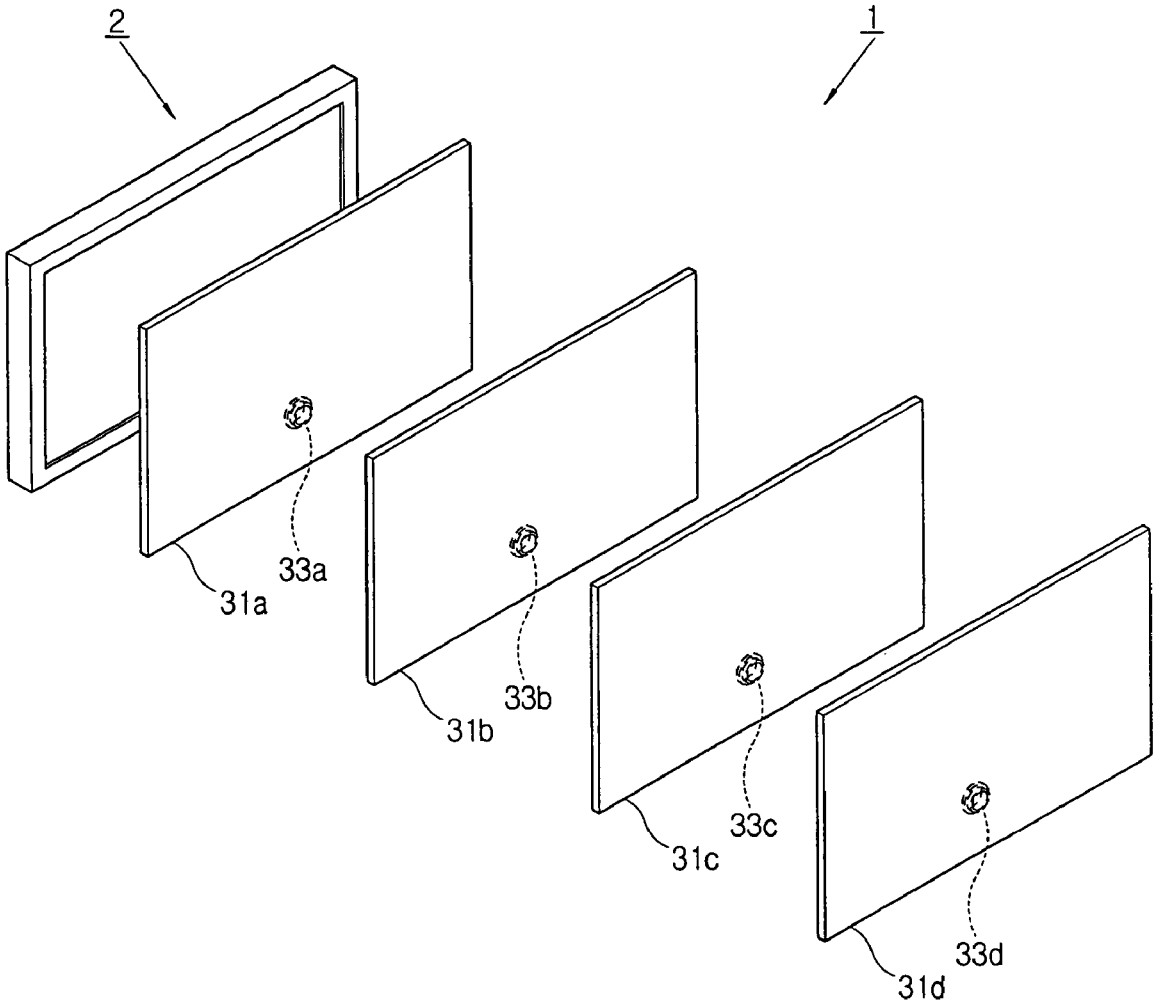
FIG. 2 illustrates a schematic exploded perspective view of a video/audio output apparatus according to an embodiment of the present invention.
Figure 3:
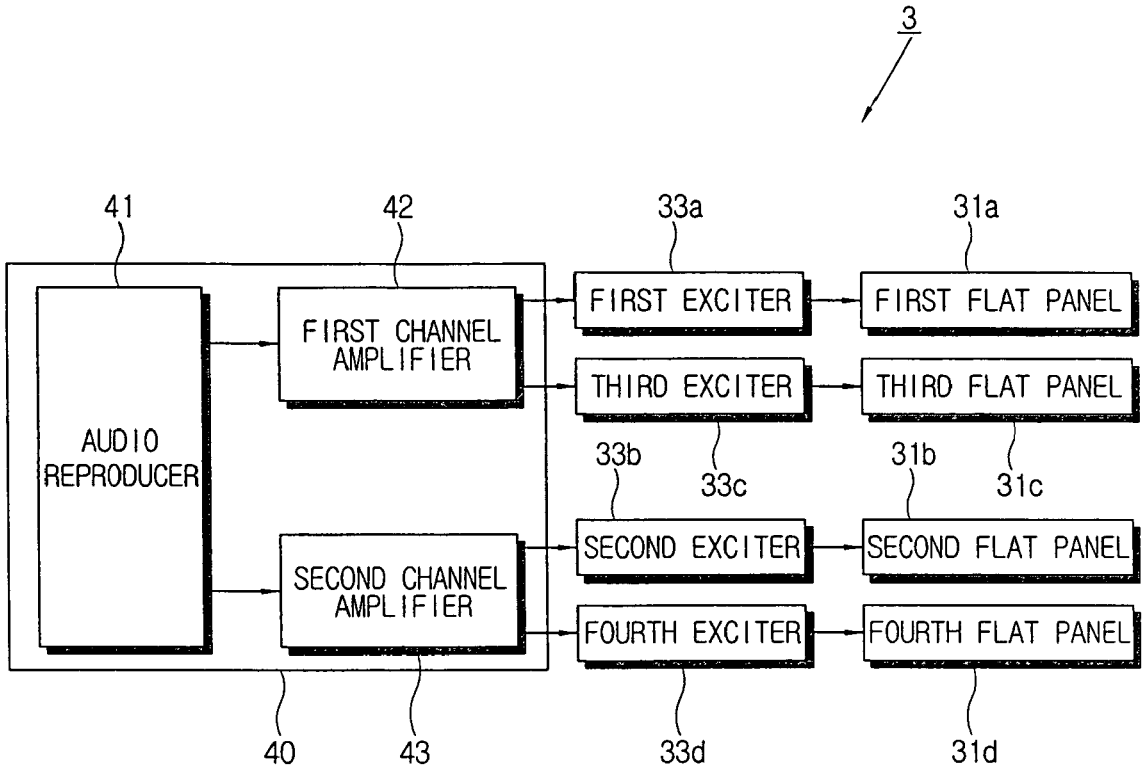
FIG. 3 illustrates a block diagram of the video/audio output apparatus according to the embodiment of the present invention shown in FIG. 2.

FIG. 2 illustrates a schematic exploded perspective view of a video/audio output apparatus according to an embodiment of the present invention, and FIG. 3 illustrates a block diagram of the video/audio output apparatus according to this embodiment of the present invention. As shown therein, a video/audio output apparatus 1 according to this embodiment of the present invention comprises a flat panel display module 2, and a flat panel audio output apparatus 3. For reference, 'flat' is a relative term indicating relative flatness. In other words, it does not matter if the flat panels do not possess a perfect flatness.

The flat panel display module 2 displays a picture based on a video signal processed by a predetermined process. According to this embodiment of the present invention, the flat panel display module 2 may include one of various type display modules such as a liquid crystal display (LCD) module, a plasma display panel (PDP) module, an organic light emitting diodes (OLED) module, etc.

The flat panel audio output apparatus 3 comprises a plurality of flat panels 31*a*, 31*b*, 31*c*, and 31*d*, and a plurality of exciters 33*a*, 33*b*, 33*c*, and 33*d*. Here, the flat panels 31*a*, 31*b*, 31*c*, and 31*d* are respectively vibrated by the exciters 33*a*, 33*b*, 33*c*, and 33*d*, thereby making a sound.

Hereinbelow, the flat panel audio output apparatus 3 according to various embodiments of the present invention will be described.

First, a flat panel audio output apparatus 3 according to one embodiment of the present invention will be described in more detail with reference to FIGS. 2 and 3.

The flat panel audio output apparatus 3 according to this embodiment of the present invention comprises a plurality of flat panels 31*a*, 31*b*, 31*c*, and 31*d* facing, and spaced apart from, each other; and a plurality of exciters 33*a*, 33*b*, 33*c*, and 33*d* placed on the respective flat panels 31*a*, 31*b*, 31*c*, and 31*d* and vibrating the respective flat panels 31*a*, 31*b*, 31*c*, and 31*d* to make sounds; and an audio signal generator 40 outputting audio signals corresponding to different channels to the respective exciters 33*a*, 33*b*, 33*c*, and 33*d*.

In this embodiment of the present invention, the audio signal generator 40 outputs audio signals corresponding to two audio channels, e.g., a stereo audio signal. Alternatively, the audio signal generator 40 may output audio signals corresponding to three or more audio channels.

Also, in this embodiment of the present invention, the flat panel audio output apparatus 3 comprises four flat panels 31*a*, 31*b*, 31*c*, and 31*d*, and four exciters 33*a*, 33*b*, 33*c*, and 33*d* placed on the respective flat panels 31*a*, 31*b*, 31*c*, and 31*d*. Alternatively, the flat panel audio output apparatus may comprise two, three, or five or more flat panels. Further, one of the flat panels may have two or more exciters to output sounds corresponding to the same channel.

Hereinbelow, the flat panels 31*a*, 31*b*, 31*c*, and 31*d* may optionally indicate a first flat panel 31*a*, a second flat panel 31*b*, a third flat panel 31*c*, and a fourth flat panel 31*d* in order of being adjacent to the flat panel display module 2. Likewise, the exciters 33*a*, 33*b*, 33*c*, and 33*d* may optionally indicate a first exciter 33*a*, a second exciter 33*b*, a third exciter 33*c*, and a fourth exciter 33*d* respectively provided on the first through fourth flat panels 31*a*, 31*b*, 31*c* and 31*d*.

The audio signal generator 40 comprises an audio reproducer 41 to output analog audio signals corresponding to a first channel and a second channel; and a first channel amplifier 42 and a second channel amplifier 43 to amplify the analog audio signals corresponding to the first and second channels outputted from the audio reproducer 41.

The audio signals corresponding to the first and second channels amplified by the first channel amplifier 42 and the second channel amplifier 43 are transmitted to the exciters 33*a*, 33*b*, 33*c*, and 33*d*.

The audio reproducer 41 may have various configurations, so long as it can output first and second channel audio signals corresponding to the first and second channels. For example, in a case in which the audio reproducer 41 is applied to a portable computer, the audio reproducer 41 may comprise a data reproducer to create a digital audio signal by reproducing various sound data such as a music file stored in a compact disc (CD) drive, a digital video disc (DVD), or a hard disk drive; and a digital/analog converter to convert the digital audio signal created by the data reproducer into the first and second channel analog audio signals, and output them to the first and second channel amplifiers 42 and 43. Here, the audio reproducer 41 may include an optical disc drive such as a CD drive and a DVD drive, and a reproducing program to reproduce the various sound data stored in the CD, the DVD, and the hard disk drive.

In the flat panel audio output apparatus 3 according to this embodiment of the present invention, the first channel audio signal outputted from the first channel amplifier 42 is transmitted to the first exciter 33*a* and the third exciter 33*c*. Further, the second channel audio signal outputted from the second channel amplifier 43 is transmitted to the second exciter 33*b* and the fourth exciter 33*d*. That is, in the flat panel audio output apparatus 3 according to this embodiment of the present invention, the first and third flat panels 31*a* and 31*c* make a sound corresponding to the first channel, and the second and fourth flat panels 31*b* and 31*d* make a sound corresponding to the second channel.

The flat panels 31*a*, 31*b*, 31*c*, and 31*d* may be rearranged to make the sounds corresponding to the first and second channels. Further, the number of the flat panels 31*a*, 31*b*, 31*c*, and 31*d* may vary. For example, among the four flat panels 31*a*, 31*b*, 31*c*, and 31*d* shown in FIG. 2, the first and second flat panels 31*a* and 31*b* may make the sound corresponding to the first channel, and the third and fourth flat panels 31*c* and 31*d* may make the sound corresponding to the second channel.

With this configuration, in the flat panel audio output apparatus 3 according to this embodiment of the present invention, each flat panel 31*a*, 31*b*, 31*c*, and 31*d* independently makes a sound corresponding to one channel, so that interference arising when one flat panel makes the sounds corresponding to two or more channels is prevented. Therefore, the sound outputted from each flat panel corresponding to one channel is improved in sound quality as compared with the sounds outputted from each flat panel corresponding to two or more channels.

Hereinbelow, a flat panel audio output apparatus 3 according to another embodiment of the present invention will be described with reference to FIGS. 4 and 5. Here, like numerals used to describe the embodiment of the present invention shown in FIGS. 2 and 3 will refer to like elements in FIGS. 4 and 5, and repetitive descriptions will be avoided as necessary.

The flat panel audio output apparatus 3 according to this embodiment of the present invention comprises a plurality of flat panels 51*a*, 51*b*, and 51*c* facing, and spaced apart from, each other; and a plurality of exciters 53*a*-R, 53*b*-R, 53*c*-R, 53*a*-L, 53*b*-L, and 53*c*-L placed on the respective flat panels 51*a*, 51*b*, and 51*c*, and vibrating the respective flat panels 51*a*, 51*b*, and 51*c* to make sounds; and an audio signal generator 60 outputting audio signals corresponding to different frequency bands to the respective exciters 53*a*-R, 53*b*-R, 53*c*-R, 53*a*-L, 53*b*-L, and 53*c*-L.

Figure 4:
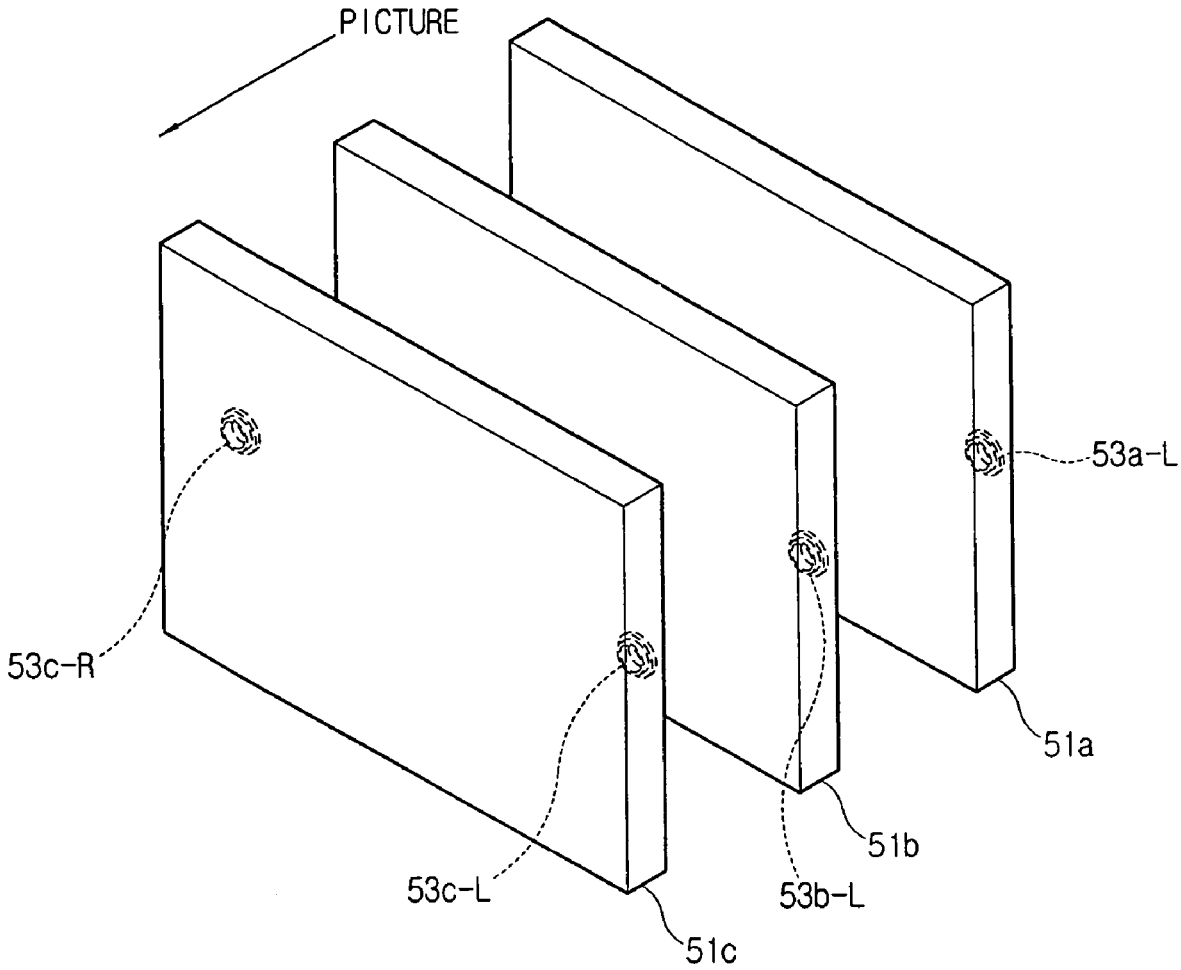
FIG. 4 illustrates a schematic exploded perspective view of a video/audio output apparatus according to another embodiment of the present invention.

FIG. 4 illustrates that the flat panel audio output apparatus 3 according to this embodiment of the present invention comprises three flat panels 51*a*, 51*b*, and 51*c* by way of example. Hereinbelow, the flat panels 51*a*, 51*b*, and 51*c* optionally indicate a first flat panel 51*a*, a second flat panel 51*b*, and a third flat panel 51*c* in order of adjacency to a flat panel display module 2.

According to this embodiment of the present invention, the first flat panel 51*a*, the second flat panel 51*b*, and the third flat panel 51*c* output audio signals according to different frequency bands. For example, the first flat panel 51*a* makes a low-pitched sound, the second flat panel 51*b* makes a middle-pitched sound, and the third flat panel 51*c* makes a high-pitched sound. Thus, the flat panel audio output apparatus 3 according to this embodiment of the present invention can be realized as a loudspeaker, and may output sounds corresponding to the respective frequency bands independently of each other without interference.

Further, the first flat panel 51*a*, the second flat panel 51*b*, and the third flat panel 51*c* may have coefficients of elasticity, related to the vibration characteristic of the respective flat panels, that are different from each other. For example, the coefficient of elasticity of the first flat panel 51*a* outputting the low-pitched sound may be lower than that of the third flat panel 51*c* outputting the high-pitched sound. Further, the coefficient of elasticity of the second flat panel 51*b* outputting the middle-pitched sound may be a value between those of the first and third flat panels 51*a* and 51*c*.

In the flat panel audio output apparatus 3 according to this embodiment of the present invention, at least one of the flat panels 51*a*, 51*b*, and 51*c* can output sounds corresponding to two channels, that is, a stereophonic sound. Preferably, though not necessarily, each of the first flat panel 51*a*, the second flat panel 51*b*, and the third flat panes 51*c* can output sounds corresponding to two channels. Thus, an analog audio signal outputted from the audio signal generator 60 includes a first channel audio signal and a second channel audio signal.

That is, the first channel audio signal comprises a first channel low-pitched audio signal, a first channel middle-pitched audio signal, and a first channel high-pitched audio signal. Likewise, the second channel audio signal comprises a second channel low-pitched audio signal, a second channel middle-pitched audio signal, and a second channel high-pitched audio signal.

Further, each of the first flat panel 51*a*, the second flat panel 51*b*, and the third flat panel 51*c* may be provided with two exciters. Also, the first channel low-pitched audio signal and the second channel low-pitched audio signal may be respectively transmitted to the first channel low-pitched sound exciter 53*a*-R and the second channel low-pitched sound exciter 53*a*-L provided in the first flat panel 51*a*. Similarly, the first channel middle-pitched audio signal and the second channel middle-pitched audio signal may be respectively transmitted to the first channel middle-pitched sound exciter 53*b*-R and the second channel middle-pitched sound exciter 53*b*-L provided in the second flat panel 51*b*. Also, the first channel high-pitched audio signal and the second channel high-pitched audio signal may be respectively transmitted to the first channel high-pitched sound exciter 53*c*-R and the second channel high-pitched sound exciter 53*c*-L provided in the third flat panel 51*c*.

Figure 5:
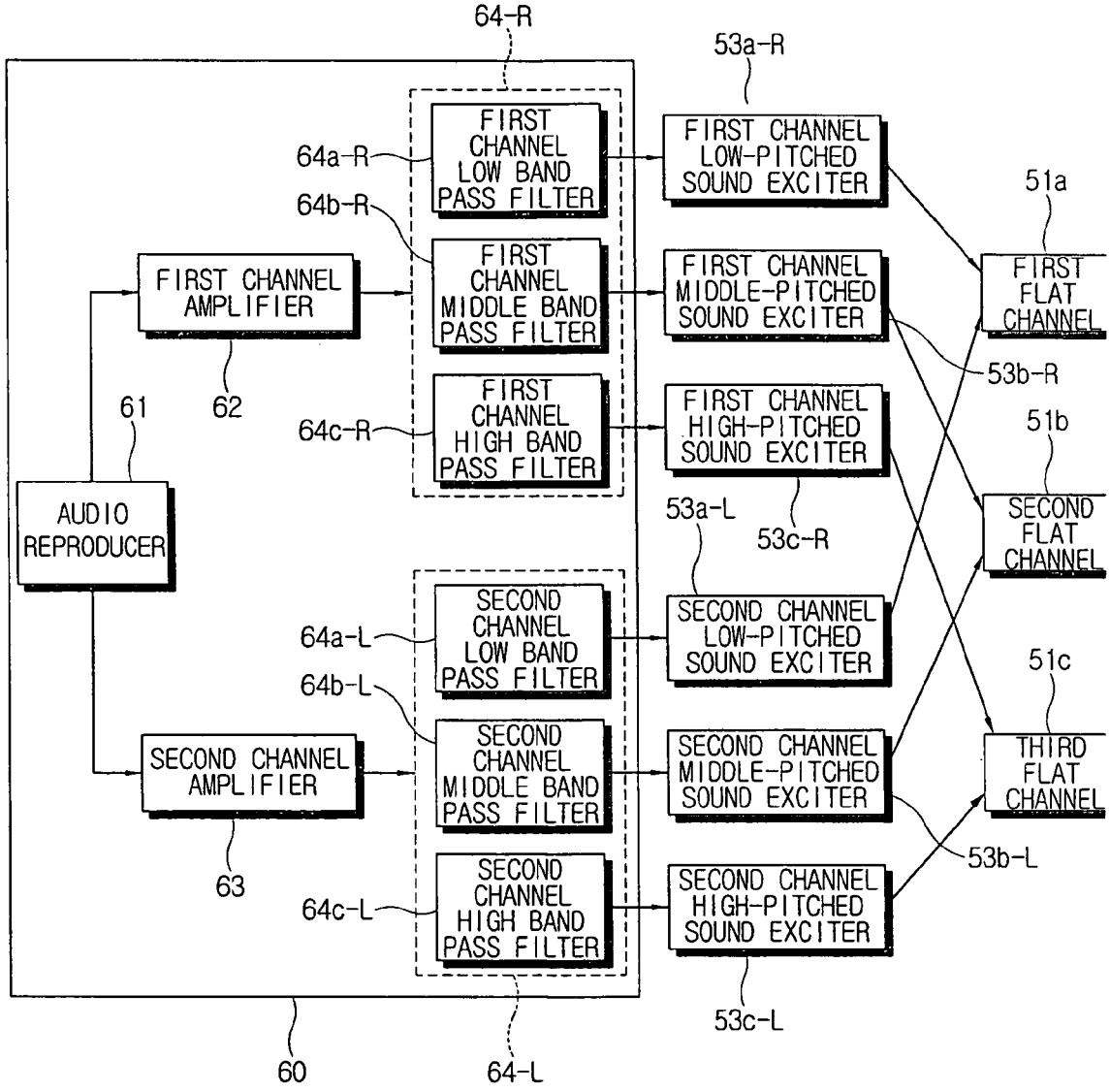
FIG. 5 illustrates a block diagram of the video/audio output apparatus according to the embodiment of the present invention shown in FIG. 4.

FIG. 5 illustrates configurations of the audio signal generator 60 for outputting the 2-channel 3-way type audio signals as described above. As shown in FIG. 5, the audio signal generator 60 comprises an audio reproducer 61 to output first and second channel analog audio signals.

The first and second channel analog audio signals outputted from the audio reproducer 61 are respectively amplified by a first channel amplifier 62 and a second channel amplifier 63, and respectively transmitted to a first network circuit 64-R and a second network circuit 64-L.

The first network circuit 64-R divides the first channel analog audio signal amplified through the first channel amplifier 62 into the first channel low-pitched audio signal, the first channel middle-pitched audio signal, and the first channel high-pitched audio signal according to the frequency bands. Here, the first network circuit 64-R comprises a first channel low band pass filter 64*a*-R to extract the first channel low-pitched audio signal from the first channel analog audio signal; a first channel middle band pass filter 64*b*-R to extract the first channel middle-pitched audio signal from the first channel analog audio signal; and a first channel high band pass filter 64*c*-R to extract the first channel high-pitched audio signal from the first channel analog audio signal.

The second network circuit 64-L comprises a second channel low band pass filter 64*a*-L; a second channel middle band pass filter 64*b*-L; and a second channel high band pass filter 64*c*-L in correspondence with the configurations of the first network circuit 64-R. Thus, the second network circuit 64-L divides the second channel analog audio signal amplified through the second channel amplifier 63 into the second channel low-pitched audio signal, the second channel middle-pitched audio signal, and the second channel high-pitched audio signal according to the frequency bands.

Figure 6:
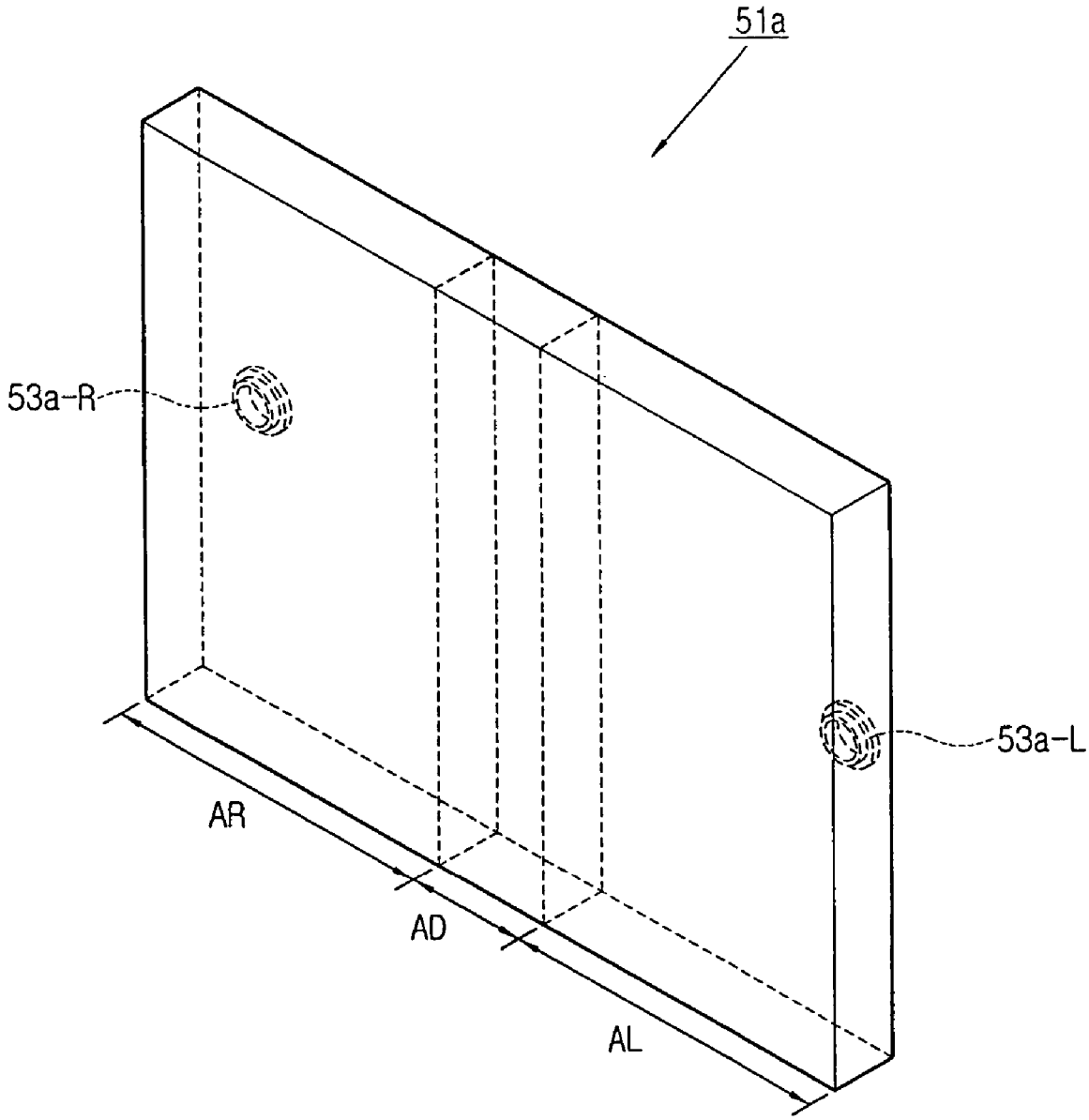
FIGS. 6 through 8 illustrate various flat panel audio output apparatuses provided in the video/audio output apparatus according to the embodiment of the present invention shown in FIG. 4.

Meanwhile, in the flat panel audio output apparatus according to this embodiment of the present invention, as shown in FIG. 6, at least one of the flat panels 51*a*, 51*b*, and 51*c* may comprise a first sound area AR to output the first channel sound, a second sound area AL to output the second channel sound, and a division area AD to divide the flat panel 51*a*, 51*b* and/or 51*c* into the first sound area AR and the second sound area AL. FIG. 6 illustrates the first flat panel 51*a* as an example.

The division area AD divides the flat panel 51*a*, 51*b*, and/or 51*c* into the first sound area AR and the second sound area AL, thereby preventing vibrations of the first and second sound areas AR and AL from interfering with each other. Thus, as the vibrations of the first and second sound areas AR and AL do not interfere with each other, flat panels 51*a*, 51*b*, and/or 51*c* are able to output the first channel sound and the second channel sound independently of each other. Consequently, multi-channel sounds are improved in sound quality, e.g., a stereophonic sound is improved according to an embodiment of the present invention.

The division area AD according to this embodiment of the present invention may mean not only a physical division between the first sound area AR and the second sound area AL, but also a spatial conception to eliminate the interference of the vibration between the first sound area AR and the second sound area AL.

The division area AD according to this embodiment may be formed by various methods.

First, the division area AD may have a different coefficient of elasticity from those of the first and second sound areas AR and AL, thereby preventing the vibrations between the first and second sound areas AR and AL from interfering with each other.

For example, a hardener can be added to the division area AD to make the division area AD have a different coefficient of elasticity from those of the first and second sound areas AR and AL. In a case in which the flat panel 51*a*, 51*b*, and 51C is made of a transparent acrylic material, epoxy resin can be used as the hardener. Here, the epoxy resin may include amine or polyamide. Preferably, though not necessarily, the hardener has the same light transmissivity as the flat panel 51*a*, 51*b*, and 51*c* has, so that a picture displayed on a flat display panel is not deteriorated.

Figure 7:
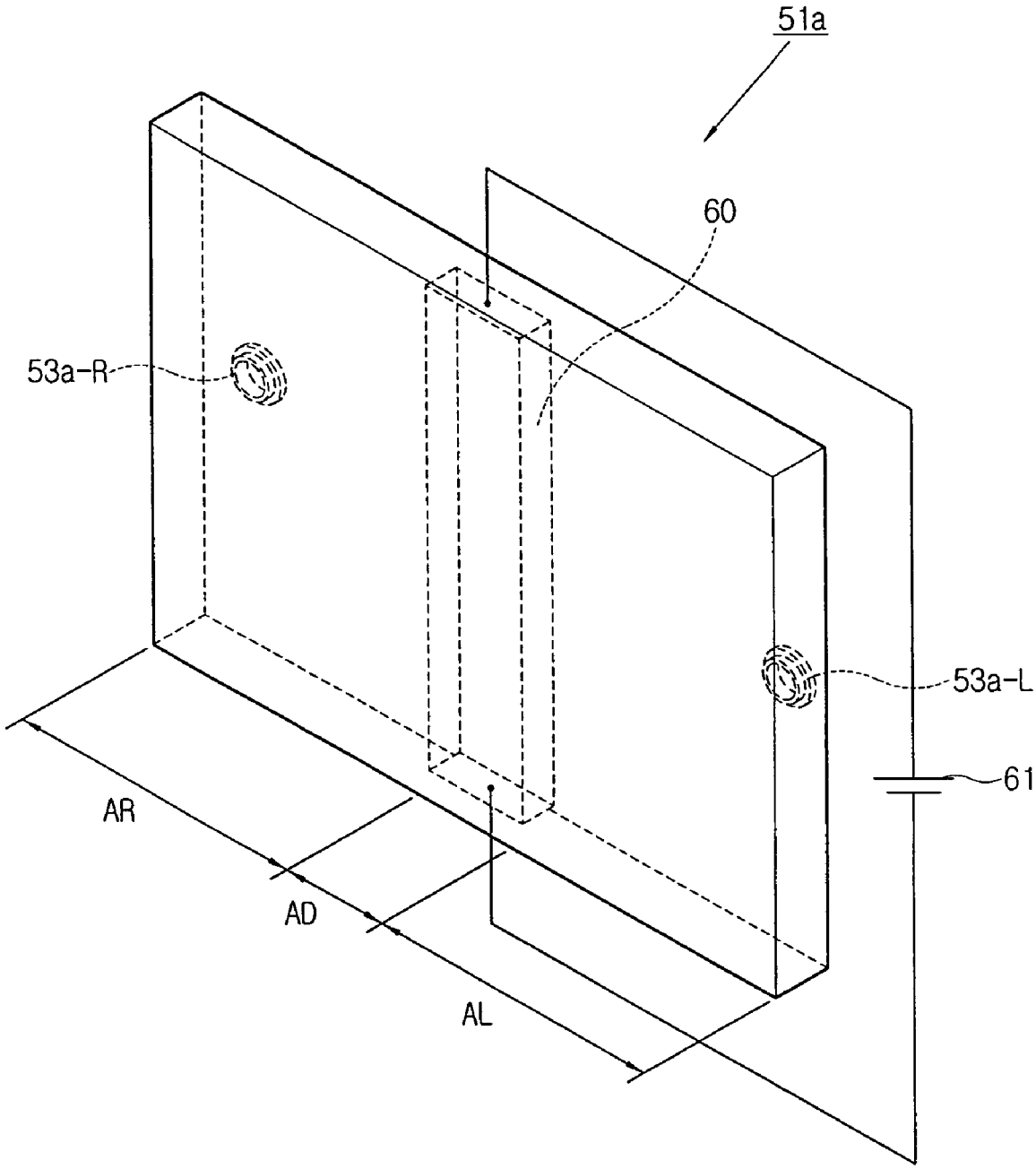

Further, as shown in FIG. 7, the division area AD can be formed by a transparent conductive body 60 provided in the division area AD, and a power supply 61 to supply power to the transparent conductive body 60.

When the power is supplied from the power supply 61 to the transparent conductive body 60, an electrical characteristic and a coefficient of elasticity of the transparent conductive body 60 are changed. Thus, the coefficient of elasticity of the division area AD provided with the transparent conductive body 60 becomes different from those of the first and second sound areas AR and AL.

Figure 8:
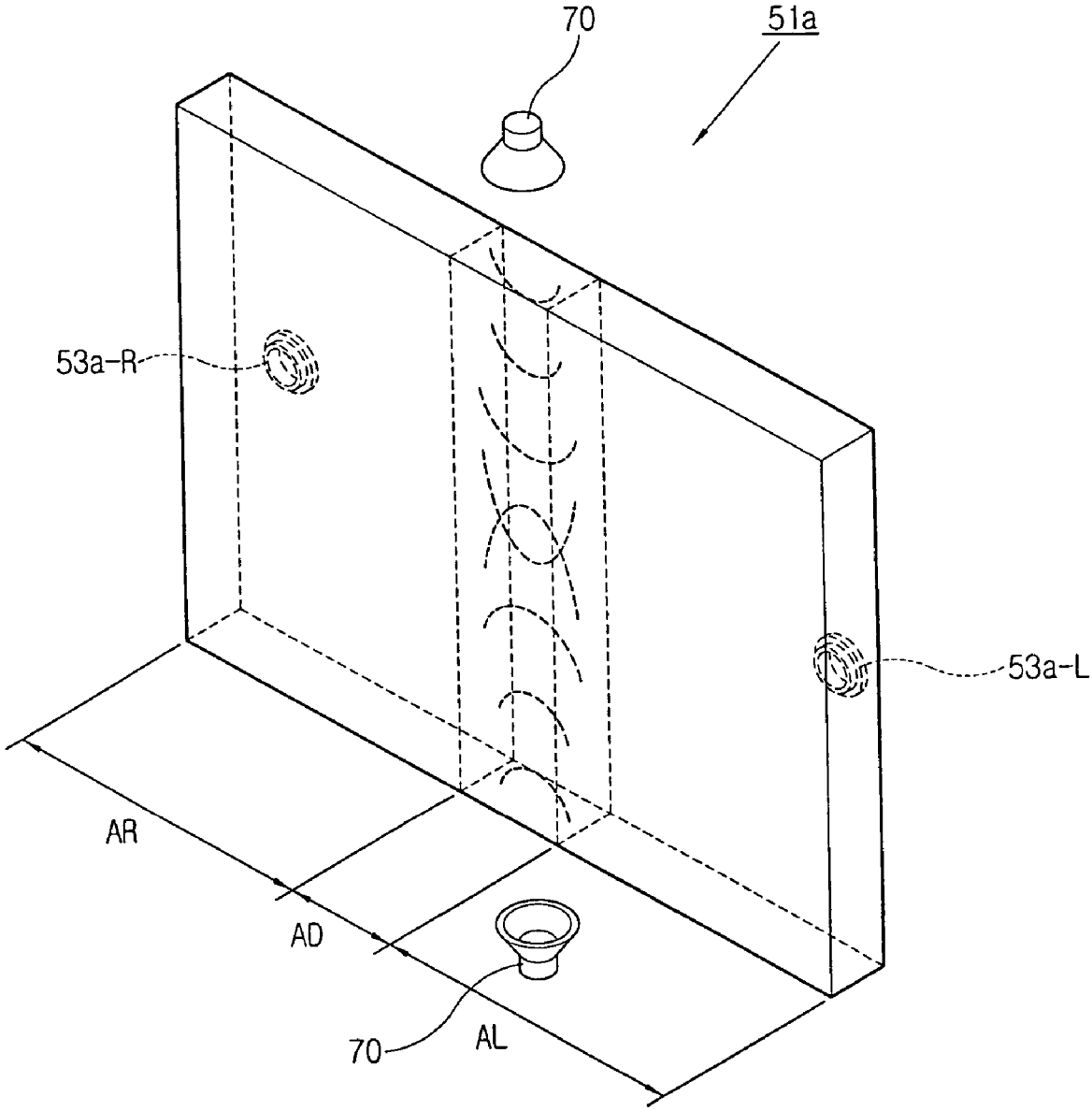

Also, as shown in FIG. 8, the division area AD can be formed by a supersonic generator 70 generating supersonic waves toward the division area AD.

In a case where the supersonic waves are emitted to the division area AD of the flat panel 51*a*, 51*b*, and 51*c*, the division area AD is vibrated by the supersonic waves. At this time, vibrations of the first and second sound areas AR and AL are canceled by the vibration of the division area AD, so that the vibrations of the first and second sound areas AR and AL do not interfere with each other. Thus, the first and second sound areas AR and AL respectively output sounds corresponding to the first and second audio channels, independently of each other, thereby improving the quality of the sounds corresponding to the multi-audio channels.

Details regarding some of the possible embodiments of the flat panel audio output apparatus shown in FIGS. 6 through 8 are described in Korean Patent Application No. 2004-0084760 applied by the same applicant and inventor.

Figure 9:
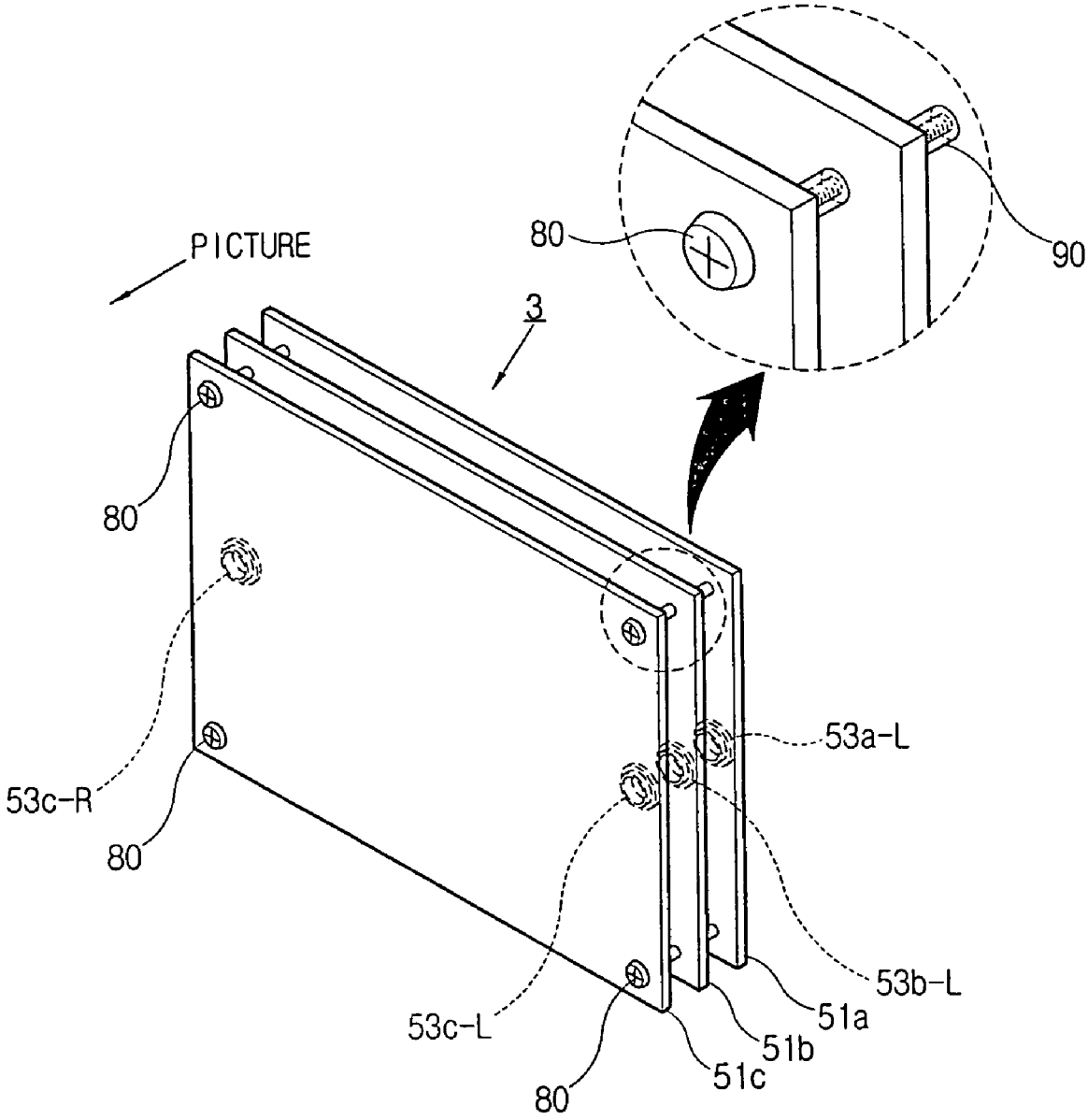
FIG. 9 illustrates a flat panel audio output apparatus according to yet another embodiment of the present invention.

FIG. 9 illustrates a flat panel audio output apparatus according to yet another embodiment of the present invention. The flat panel audio output apparatus 3 according to this embodiment of the present invention comprises a plurality of flat panels 51*a*, 51*b*, and 51*c* facing, and spaced apart from, each other; and a plurality of exciters 53*a*-R, 53*b*-R, 53*c*-R, 53*a*-L, 53*b*-L, and 53*c*-L placed on the respective flat panels 51*a*, 51*b*, and 51*c*, and vibrating the respective flat panels 51*a*, 51*b*, and 51*c* to make sounds; and an audio signal generator 60 outputting audio signals corresponding to different frequency bands to the respective exciters 53*a*-R, 53*b*-R, 53*c*-R, 53*a*-L, 53*b*-L, and 53*c*-L.

The flat panel audio output apparatus according to this embodiment of the present invention may further comprise a supporting member supporting the respective flat panels to face, and be spaced apart from, each other. As shown in FIG. 9, the supporting member may comprise a screw 80 coupled to a screw hole (not shown) formed on one or more edges of the respective flat panels.

Also, an anti vibration member 90 may be disposed between the respective flat panels to prevent the vibration thereof from being transmitted to other flat panels via the supporting member. In this embodiment of the present invention, the screw 80 is coupled to the respective flat panels by penetrating the respective anti vibration member 90, and the anti vibration member 90 is disposed between the respective flat panels by way of example.

In the embodiment of the present invention shown in FIG. 2, the plurality of flat panels 31*a*, 31*b*, 31*c*, and 31*d* output the sounds corresponding to the different channels, independently of each other. In the embodiment of the present invention shown in FIG. 4, the plurality of flat panels 51*a*, 51*b*, and 51*c* respectively output the sounds corresponding to different frequency bands of the different channels. Further, in the embodiment of the present invention shown in FIG. 6, the flat panel or panels outputting the sound corresponding to one or more channels can be divided by the division area AD into a plurality of sound areas, and the exciter can be provided in each sound area. Further, the sound areas of one flat panel may respectively output the sounds corresponding to different frequency bands, so that the flat panel audio output apparatus 3 according to the embodiment of the present invention shown in FIG. 2 can be realized as a multi-channel loudspeaker.

Further, the video/audio output apparatus 1 according to an embodiment of the present invention may include various apparatuses so long as it can output a sound using an embodiment of the foregoing flat panel audio output apparatus 3. For example, the video/audio output apparatus 1 according to an embodiment of the present invention may include a monitor, a television, a portable computer, a mobile pone, a personal digital assistant (PDA), or the like, which can not only display a picture but also make a sound.

Further, the division area AD of the flat panel may be formed as in one of the foregoing embodiments, but is not limited to these embodiments, and may be formed by a combination of the foregoing embodiments.

Further, in the foregoing embodiments, an exciter is employed as a vibrator to vibrate the flat panels 31*a* through 31*d* and 51*a* through 51*c*. However, the vibrator is not limited to an exciter, and may vary so long as it can vibrate the flat panels 31*a* through 31*d* and 51*a* through 51*c* on the basis of the audio signal generated from the audio signal generator 40 or 60. For example, the vibrator may include various actuators such as a piezoelectric actuator, which can vibrate the flat panels 31*a* through 31*d* and 51*a* through 51*c* to make a sound.

As described above, the present invention provides a flat panel audio output apparatus, and a video/audio output apparatus, in which a plurality of flat panels are divided according to a plurality of channels and/or according to a plurality of frequency bands, and make sounds accordingly, so that a multi-channel audio output apparatus and/or loudspeaker can be realized, and at the same time sound quality is prevented from being deteriorated due to interference between the channels and/or between the frequency bands, thereby enhancing the sound quality.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A video/audio output apparatus comprising:

a flat panel display module to display a picture;

a plurality of flat panels spaced apart from one another, each of the flat panels facing at least one of the remaining flat panels, provided in front of a surface of the flat panel display module;

one or more vibrators respectively provided to each of the flat panels to vibrate each of the flat panels to make a sound; and an audio signal generator to transmit audio signals corresponding to different frequency bands to the respective vibrators, wherein at least one of the flat panels comprises a plurality of sound areas, and a division area to divide the at least one flat panel into the sound areas to prevent vibrations of the sound areas from interfering with each other.

2. The video/audio output apparatus according to claim 1, further comprising at least one supporting member to support the plurality of flat panels so that each of the flat panels is spaced apart from one another.

3. The video/audio output apparatus according to claim 2, further comprising an anti vibration member disposed between each of the flat panels, to prevent vibration of a first one of the flat panels from being transmitted to a second one of the flat panels.

4. A video/audio output apparatus comprising:

a flat panel display module to display a picture;

a plurality of flat panels spaced apart from one another, each of the flat panels facing at least one of the remaining flat panels, provided in front of a surface of the flat panel display module;

one or more vibrators respectively provided to each of the flat panels to vibrate each of the flat panels to make a sound; and an audio signal generator to transmit audio signals corresponding to different frequency bands to the respective vibrators, wherein each of the respective flat panels have different coefficients of elasticity from each other; and the audio signal generator outputs the audio signals having the different frequency bands to each of the respective vibrators according to the coefficients of elasticity of the flat panels.

5. A video/audio output apparatus comprising:

a flat panel display module to display a picture;

a plurality of flat panels spaced apart from one another, each of the flat panels facing at least one of the remaining flat panels, provided in front of a surface of the flat panel display module;

one or more vibrators respectively provided to each of the flat panels to vibrate each of the flat panels to make a sound; and an audio signal generator to transmit audio signals corresponding to different frequency bands to the respective vibrators, wherein each of the respective flat panels have different coefficients of elasticity from each other; and the audio signal generator outputs the audio signals having the different frequency bands to each of the respective vibrators according to the coefficients of elasticity of the flat panels, wherein at least one of the flat panels comprises a plurality of sound areas, and a division area to divide the at least one flat panel into the sound areas to prevent vibrations of the sound areas from interfering with each other;

at least one of the vibrators is provided on each of the sound areas; and the audio signal generator respectively outputs the audio signals corresponding to different channels of a same frequency band to the at least one vibrator provided on each of the sound areas of the at least one flat panel.

6. The video/audio output apparatus according to claim 5, wherein the division area has a coefficient of elasticity different from the coefficient of elasticity of the sound areas.

7. The video/audio output apparatus according to claim 6, wherein the division area comprises a hardener, which causes the coefficient of elasticity different from the coefficient of elasticity of the sound areas.

8. The video/audio output apparatus according to claim 6, further comprising:

a transparent conductive body provided in the division area; and a power supply to supply power to the transparent conductive body, which causes the coefficient of elasticity different from the coefficient of elasticity of the sound areas.

9. The video/audio output apparatus according to claim 6, further comprising a supersonic generator to emit supersonic waves to the division area to prevent the vibrations of the sound areas from interfering with each other.

* * * * *